US005839664A

United States Patent [19]

Relyea

[11] Patent Number: 5,839,664

[45] Date of Patent: Nov. 24, 1998

[54] FLUID DISCHARGE NOZZLE ASSEMBLY

[75] Inventor: Robert G. Relyea, Dallas, Tex.

[73] Assignee: Crash Rescue Equipment Service, Inc,, Dallas, Tex.

[21] Appl. No.: 688,901

[22] Filed: Jul. 31, 1996

[51] Int. Cl.[6] ..... A62C 31/00; B05B 15/08

[52] U.S. Cl. ..... 239/271; 239/172; 239/446; 239/587.5; 169/70

[58] Field of Search ..... 239/146, 172, 239/175, 271, 436, 442, 443, 444, 446, 587.1, 587.5, 588; 169/70

[56] References Cited

U.S. PATENT DOCUMENTS

| | | | |
|---|---|---|---|
| 1,735,376 | 11/1929 | Carey | 239/588 X |
| 2,538,211 | 1/1951 | Prout | 239/446 |
| 2,993,650 | 7/1961 | Badberg | 239/443 X |
| 3,112,073 | 11/1963 | Larson et al. | 239/446 |
| 4,271,909 | 6/1981 | Chatfield, Jr. et al. | 169/70 |
| 4,802,535 | 2/1989 | Bakke | 239/271 X |
| 5,211,245 | 5/1993 | Relya et al. | 169/24 |
| 5,301,756 | 4/1994 | Relyea et al. | 169/24 |

*Primary Examiner*—Andres Kashnikow
*Assistant Examiner*—Robin O. Evans
*Attorney, Agent, or Firm*—Jones, Day, Reavis & Pogue

[57] ABSTRACT

A fluid discharge nozzle assembly that has both a piercing nozzle for fighting fires behind a wall member and a foam/spray nozzle for applying fire-retardant fluid to an open fire. The piercing nozzle is movable only in a vertical plane. The foam spray nozzle is movable in both the vertical plane with the piercing nozzle and in a direction perpendicular to the vertical plane so that, when the piercing nozzle is to be used, the foam/spray nozzle is movable to a position perpendicular to the longitudinal axis of the piercing nozzle to provide maximum clearance of the piercing nozzle during use of the piercing nozzle.

8 Claims, 3 Drawing Sheets

FLUID DISCHARGE NOZZLE ASSEMBLY

BACKGROUND OF THE INVENTION

1. Field of the Invention

The present invention relates to vehicle aerial lifts in general and in particular to an aerial lift that has a boom that can be extended in front of a vehicle cab and that has a fluid discharge nozzle assembly mounted on the outer end of the aerial boom with a fluid conduit for supplying fire-retardant fluid to the nozzle assembly that includes an elongated hollow piercing nozzle and an elongated foam/water nozzle mounted on the outer end of the boom. The piercing nozzle moves only in the vertical plane while the foam/water nozzle can move with the piercing nozzle in the vertical plane and can also move in either direction perpendicular to the longitudinal axis of the hollow piercing nozzle. When the piercing nozzle is manually selected, the foam/water nozzle automatically moves to a position perpendicular to the longitudinal axis of the piercing nozzle so that it can be positioned as remotely as possible from the outer end of the piercing nozzle to allow maximum penetration of the piercing nozzle into a hollow object in which a fire may be contained without interference of the foam/water nozzle.

2. Description of Related Art Including Information Disclosed Under 37 CFR 1.97 and 1.98

There is disclosed in commonly assigned U.S. Pat. No. 5,301,756 a piercing nozzle on the outer end of a boom which has a hardened steel point including a sprayer unit. The piercing nozzle can be forced through the wall of a structure containing a fire so that flame retardant fluid may be injected through the sprayer unit directly into the interior of the structure. Further, a foam/water nozzle is also mounted on the outer end of the boom and is disclosed in commonly assigned U.S. Pat. No. 5,211,245. In the systems disclosed by both of these patents, a first rotatable fluid connection is coupled to the discharge nozzle assembly and allows the nozzle assembly to be positioned only in a vertical plane from substantially +45 degrees to −180 degrees. A second rotatable fluid connection couples the discharge nozzle assembly to the first rotatable fluid connection and allows the nozzle assembly to be positioned to ±90 degrees only in a plane perpendicular to the vertical plane.

The system in both of these patents requires an elongated piercing nozzle which extends parallel to and far beyond the outer end of the foam/water nozzle assembly so that the piercing nozzle will have ample distance in which to penetrate a wall or container. These systems require a stop collar mounted on the piercing nozzle to allow penetration of the piercing nozzle into a structure only a predetermined distance so as not to damage the foam/water nozzle assembly. Some foam/water nozzles are elongated and therefore cannot be used with the piercing nozzle unless the piercing nozzle is extremely elongated.

It would be advantageous to have a nozzle assembly having both a piercing nozzle and a foam/water nozzle and in which the foam/water nozzle can be moved out of the way during use of the piercing nozzle.

It would also be advantageous to have the foam/water nozzle assembly moved automatically out of the way of the piercing nozzle whenever the piercing nozzle has been manually selected.

SUMMARY OF THE INVENTION

Thus the present invention relates to an aerial boom system for a fire-fighting vehicle that has a fluid discharge nozzle assembly mounted on the outer end of an aerial boom and which includes an elongated hollow piercing nozzle and an elongated foam/water nozzle mounted on the outer end of the boom such that the elongated foam/water nozzle can be moved in a direction perpendicular to the elongated axis of the piercing nozzle whenever the piercing nozzle is used.

It is therefore an object of the present invention to provide an aerial boom system in which, when the piercing nozzle is selected for use, the elongated hollow foam/water nozzle is automatically rotated out of the position in which it is ordinarily placed so that it can be positioned as far as possible away from the outer end of the piercing nozzle to allow maximum penetration of the piercing nozzle into a wall for fighting a fire.

It is also an object of the present invention to provide an aerial boom system for a fire-fighting vehicle having a fluid discharge nozzle assembly mounted on the outer end of an aerial boom that includes both an elongated hollow piercing nozzle and an elongated foam/water nozzle such that the elongated foam/water nozzle can be rotated from a first position parallel to the longitudinal axis of the piercing nozzle to a second position perpendicular to the longitudinal axis of the piercing nozzle so that maximum penetration of the piercing nozzle through a wall can take place.

It is another object of the present invention to provide an aerial boom system for a fire-fighting vehicle having a fluid discharge nozzle assembly mounted on the outer end of an aerial boom with both an elongated hollow piercing nozzle and an elongated foam/water nozzle and including a switch for selecting the hollow piercing nozzle for use and wherein when the switch is actuated to select the hollow piercing nozzle, it causes the foam/water nozzle to be to be automatically moved to a second position essentially perpendicular to a first position that is essentially parallel to and spaced vertically from the longitudinal axis of the elongated piercing nozzle so as to be as far as possible from of the outer end of the piercing nozzle when the piercing nozzle is to be used.

Thus the present invention relates to a fluid discharge nozzle assembly for an aerial boom system for a fire-fighting vehicle. It comprises an elongated hollow piercing nozzle coupled to a fluid conduit and having at least one orifice on the outer end thereof for expelling fire-retardant fluid. The nozzle has use in penetrating a wall member to extinguish a fire behind the wall. A first pivotable mounting support is formed on the outer end of the boom to support the hollow piercing nozzle for selective pivotal movement in a vertical plane only. A second pivotable mounting support is coupled to the first pivotable mounting support and is pivotable only in a plane perpendicular to the longitudinal axis of the elongated piercing nozzle. An elongated fluid spray nozzle is mounted on the second pivotal mounting means with its longitudinal axis in a first position essentially parallel to and spaced vertically from the longitudinal axis of the elongated piercing nozzle. The elongated spray nozzle is enabled to be moved from its first position to a second position essentially perpendicular to its first position to be as far as possible away from the outer end of the piercing nozzle when the piercing nozzle is to be used.

BRIEF DESCRIPTION OF THE DRAWINGS

These and other features of the present invention will be more fully disclosed when taken in conjunction with the following DETAILED DESCRIPTION OF THE PREFERRED EMBODIMENT(S) in which like numerals represent like elements and in which.

DETAILED DESCRIPTION OF THE PREFERRED EMBODIMENT(S)

Figure 1:
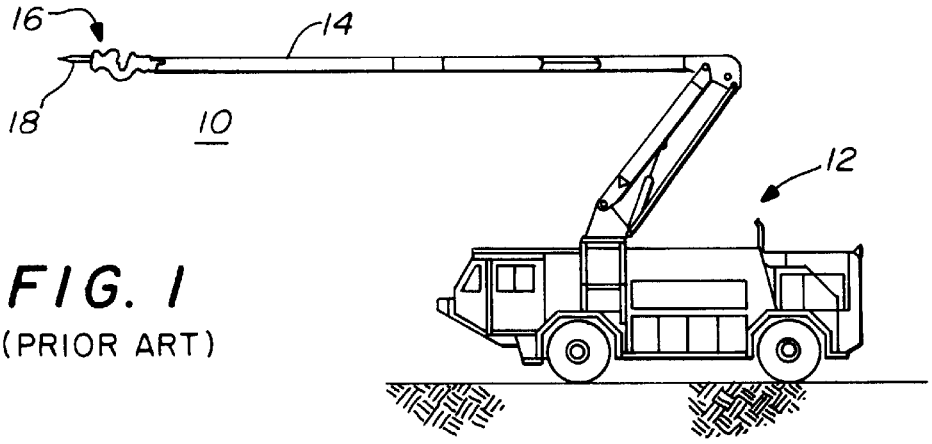
FIG. 1 (PRIOR ART)
FIG. 1 is an elevation view of a prior art aerial boom system illustrating a piercing nozzle on the outer end thereof.

FIG. 1 is an elevation view of the fire-fighting vehicle 10 of the prior art having an aerial foam system. The vehicle body 12 has an aerial boom 14 mounted thereon for movement in both the vertical and horizontal planes. A piercing nozzle assembly 16 forms at least a part of the nozzle assembly and is mounted on the outer end of boom 14 with a hollow piercing nozzle 18 extending forwardly of the boom 14. This system is described in detail in U.S. Pat. Nos. 5,211,245 and 5,301,756, both of which are incorporated herein by reference in their entirety.

Figure 2:
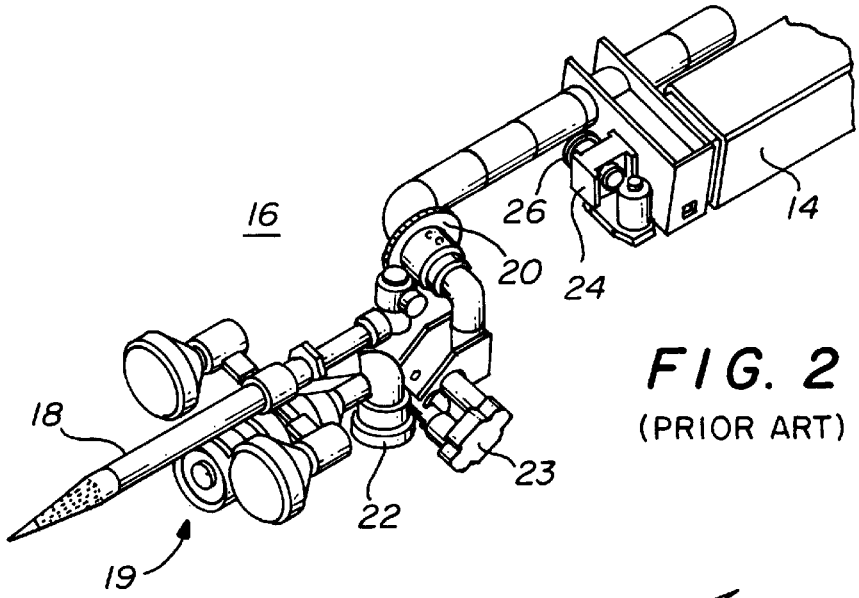
FIG. 2 (PRIOR ART)
FIG. 2 is an isometric view of a piercing nozzle assembly of the prior art mounted on the front end of a boom and illustrating a slip clutch mounted between the outer end of the boom and a drive means such that the undesirable forces on the elongated nozzle are limited to a predetermined value in the Y plane perpendicular to the piercing direction of the elongated nozzle.

FIG. 2 is an isometric view of the piercing nozzle assembly 16 of the prior art mounted on the front end of the boom 14. A slip clutch is mounted between the outer end of the boom and the drive means, as described in commonly assigned U.S. Pat. No. 5,301,756, such that any undesirable forces on the elongated nozzle are limited to a predetermined value in the Y plane perpendicular to the piercing direction of the elongated nozzle. It will be noted that the foam/water nozzle 19 is mounted substantially parallel with and spaced vertically from the piercing nozzle 18. When the piercing nozzle 18 is selected for use, a stop collar (not shown) must be used as disclosed in U.S. Pat. No. 5,301,756 to prevent the piercing nozzle from penetrating a wall to such a distance that it may damage the foam/water nozzle assembly 19. The slip clutch assembly 24 is mounted between the outer end of boom 14 and drive gear or wheel 26. A drive chain, shown in commonly assigned U.S. Pat. No. 5,301,756, is coupled between gear or wheel 26 and gear wheel 20 to move the piercing nozzle 18 and spray nozzle 19 in a vertical plane. Pivotable coupling 22, driven by motor 23, enables the piercing nozzle 18 and the spray nozzle 19 to be driven in a plane perpendicular to the vertical plane. Thus both nozzles 18 and 19 are driven together simultaneously in both the horizontal and vertical planes. It can be seen that the piercing nozzle 18 must extend far beyond spray nozzle 19 and also use a stop collar as described in U.S. Pat. No. 5,211,245 to protect the spray nozzle 19.

Figure 3:
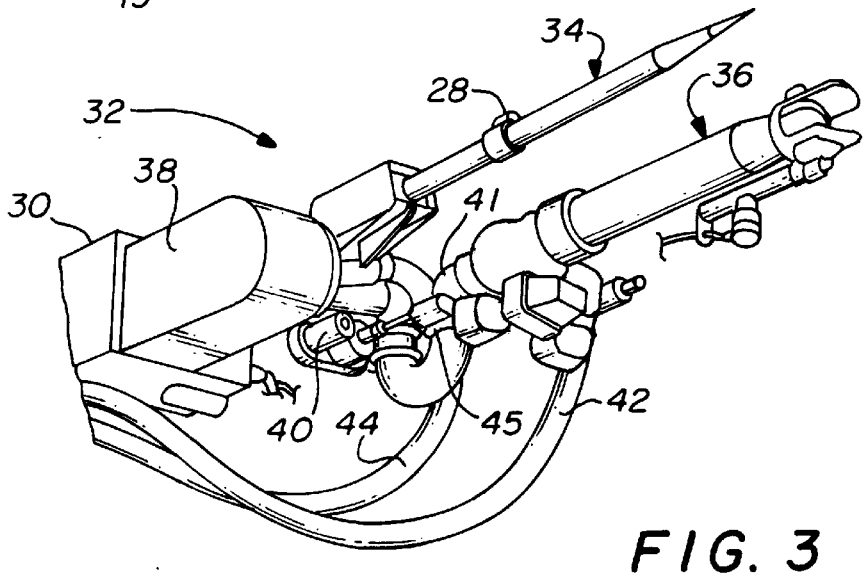
FIG. 3 is an isometric view of the novel nozzle assembly of the present invention having both a piercing nozzle and a foam/water nozzle in essentially a parallel arrangement and with the piercing nozzle being movable only in a vertical plane.
Figure 4:
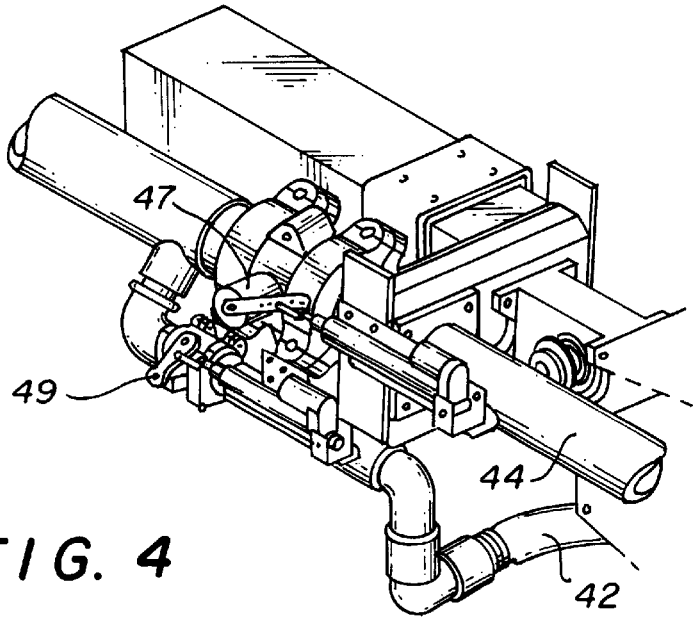
FIG. 4 is an isometric view of the fluid valve assembly.
Figure 5:
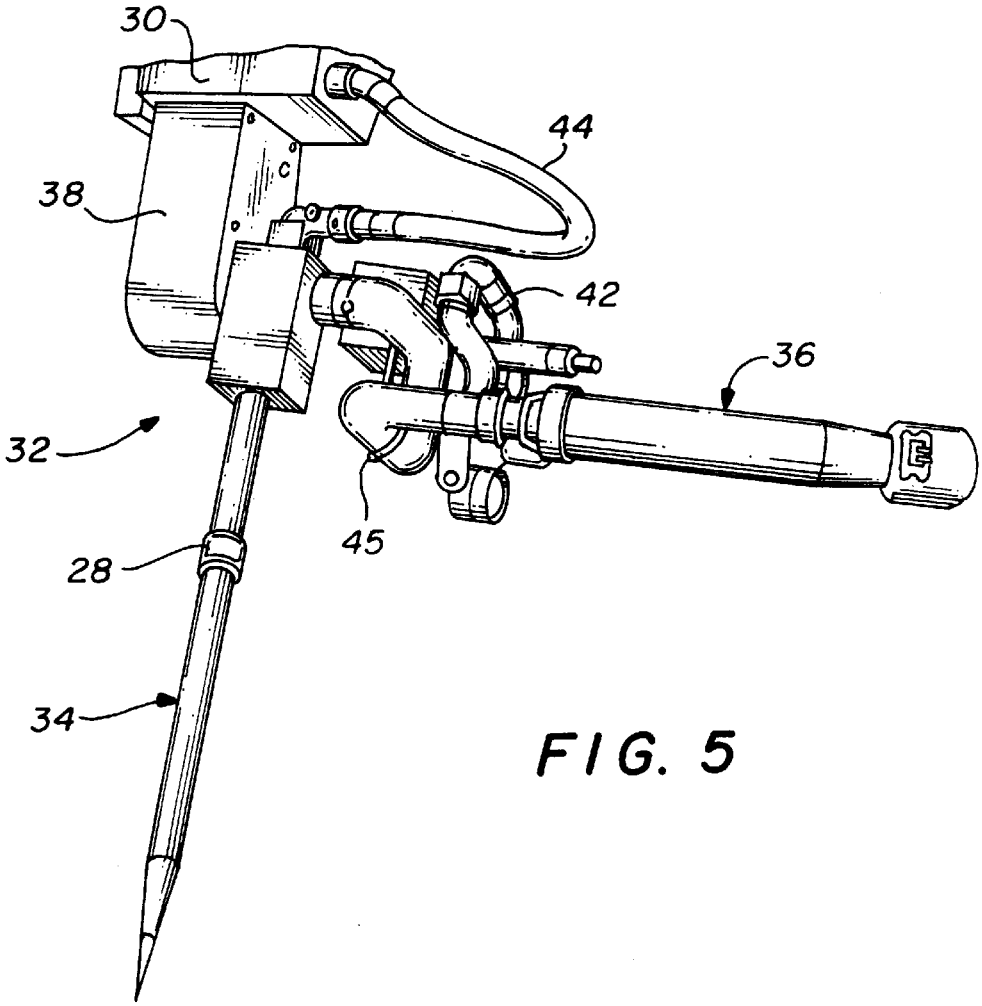
FIG. 5 is a top isometric view of the novel nozzle assembly of the present invention and illustrating that when the piercing nozzle is selected, the foam/water nozzle can be moved in a direction perpendicular to the longitudinal axis of the piercing nozzle to be as far as possible away from the outer end of the piercing nozzle to avoid any requirement to utilize a special extended length piercing nozzle.
Figure 6:
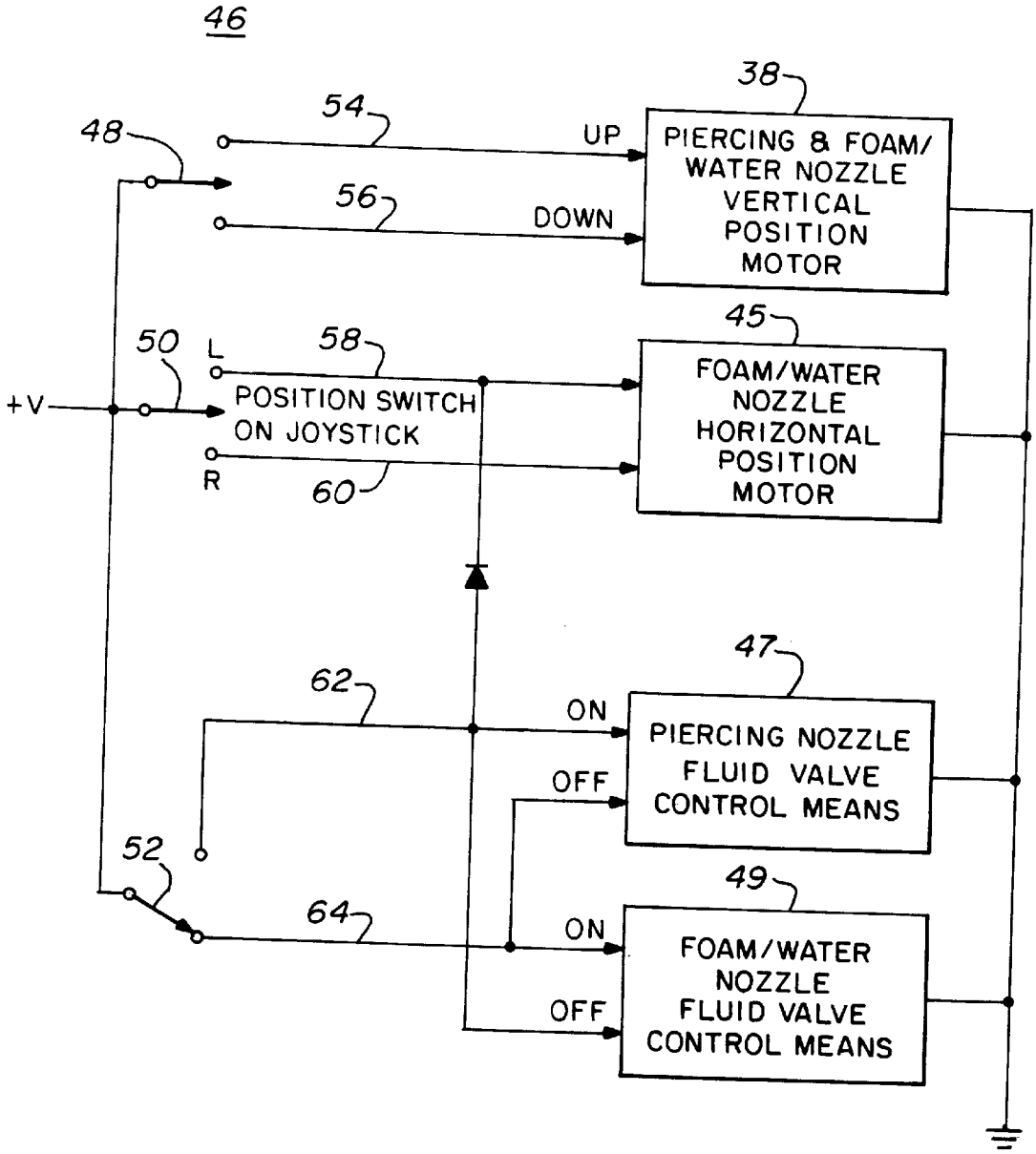
FIG. 6 is a circuit diagram of the electrical system of the present invention illustrating that when the piercing nozzle is manually selected, a signal is automatically sent to the elongated foam/water nozzle horizontal position motor to move the elongated foam/water nozzle assembly out of the path of longitudinal alignment with the piercing nozzle to a position perpendicular to the longitudinal axis of the piercing nozzle.

FIG. 3 illustrates the improved fluid discharge nozzle assembly 32 of the present invention. Assembly 32 is attached to the outer end of a boom 30 such that the piercing nozzle 34 moves only in a vertical plane. When the piercing nozzle is allowed to rotate in the horizontal plane, as it did in the prior art, the operator is required to position the nozzle parallel to the boom for proper alignment for penetrating an object. Operator errors that allow the piercing nozzle to be a few degrees off center generate tremendous stress on nozzle components (horizontal drive mechanism) and unwanted side forces on the boom. Restricting the piercing nozzle to a vertical movement only, as in the present invention, eliminates stress on the nozzle's horizontal drive mechanism and greatly reduces the possibility of side forces on the boom. The clutching mechanism of the previous invention is thus better utilized in preventing damage to other nozzle and boom components when penetrating objects. The foam/water nozzle 36 is also elongated and extends parallel to and is spaced generally vertically from the piercing nozzle 34. A motor assembly in housing 38 is similar to that shown U.S. Pat. No. 5,301,756 and moves the elongated hollow piercing nozzle in a vertical direction to and from a first position essentially parallel to the longitudinal axis of the aerial boom 30 in only a vertical plane. A powered device such as an electric motor or a hydraulic motor rotates a mount 41 that supports the foam/water nozzle for pivotal movement between a first position essentially parallel to and spaced vertically from the longitudinal axis of the piercing nozzle as shown in FIG. 3 and a second position essentially perpendicular to its first position as shown in FIG. 5. Hoses 42 and 44 supply hydraulic fluid to both the foam/water nozzle assembly 36 and the piercing nozzle 34. As shown in FIG. 6, a switch 52 controls a valve assembly including valves 47, 49 shown in FIG. 4 for selectively coupling fluid to fluid hoses 42 and 44 and to the corresponding piercing nozzle 34 or foam/water nozzle 36 when the switch is in a first position or a second position, respectively.

A circuit means (shown in FIG. 5) in the form of diode 53 couples the valve assembly control switch 52 to a powered mounting means or motor 45 such that when the switch 50 is in its position the valve 47 couples fluid to the piercing nozzle 34 through hose 44 and the powered mounting means 45 is automatically energized through diode 53 to move the foam/water nozzle 36 to its second position with its longitudinal axis essentially perpendicular to the longitudinal axis of the piercing nozzle. The piercing nozzle 34 can be positioned by manually controlling joystick 48 to line 54 to supply current to motor 38 to move the piercing nozzle up or to line 56 to move the piercing nozzle down in the vertical plane. Joystick 50 also moves the foam/water nozzle 36 in a left direction (line 58) or right direction (line 60) perpendicular to the vertical plane in which the piercing nozzle 34 moves by controlling the current to motor 45.

Switch 52, in one position, couples to line 64 and selects the valve that provides fire-fighting fluid to the foam/water nozzle. At the same time it forces valve 47 to the OFF position. When switch 52 is used to manually select the piercing nozzle, it energizes valve 47 and de-energizes valve 49 through line 62. As stated above, it simultaneously energizes motor 45 through diode 53 to move the foam/ water nozzle 36 to its second position shown in FIG. 5. Appropriate circuits well known in the art including microswitches, can be used to drive the foam/water nozzle to its second position where a microswitch (not shown) stops the current to the data motor.

Thus, there has been disclosed a novel aerial boom nozzle system that includes a piercing nozzle and a foam/water nozzle mounted on the outer end of an aerial boom. The nozzle system has a first pivotable joint for movement in only the vertical plane. The piercing nozzle is mounted on the end of the boom such that it moves with the pivotable joint only in the vertical plane. An elbow extension leads from the first pivotable joint to a second pivotable joint that moves only in a plane perpendicular to the vertical plane. The foam/water nozzle is mounted on the end of the boom such that it moves in the vertical plane when the first joint is pivoted and also moves in the plane perpendicular to the vertical plane when the second joint is pivoted. This convention allows the foam/water nozzle to be moved from a first position essentially parallel to and spaced vertically from the piercing nozzle to a second position perpendicular to the longitudinal axis of the piercing nozzle when the piercing nozzle is to be used thus providing the greatest clearance and unobstructed use of the piercing nozzle.

Further, a switch is used to select the nozzle to be used; i.e., the piercing nozzle or the foam/water nozzle. The switch is connected to a motor for automatically driving the foam/water nozzle to its second position when the piercing nozzle is selected. This saves time since the operator is not required to first move the foam/water nozzle to its second position and then select the piercing nozzle.

The corresponding structures, materials, acts, and equivalents of all means or step plus function elements in the claims below are intended to include any structure, material, or act for performing the function in combination with other claimed elements as specifically claimed.

What is claimed is:

1. In an aerial boom system for a fire-fighting vehicle that has a discharge nozzle assembly mounted on the outer end of an aerial boom and a fluid conduit for supplying fire-retardant fluid to the nozzle assembly, the fluid discharge nozzle assembly enhancing the ability to extinguish fire within an enclosure and comprising:

an elongated hollow piercing nozzle mounted on the outer end of said aerial boom with its longitudinal axis in a first position essentially parallel to the longitudinal axis of said aerial boom and coupled to the fluid conduit, said piercing nozzle having movement only in a vertical plane from its first position and having at least one orifice therein for expelling said fire-retardant fluid;

an elongated foam/water nozzle pivotally mounted on the outer end of the boom for movement between a first position with its longitudinal axis essentially parallel to and spaced vertically from the longitudinal axis of said piercing nozzle to a second position essentially perpendicular to its first position;

a switch controlled valve assembly for selectively coupling said fluid in said fluid conduit either to said piercing nozzle or to said foam/water nozzle when a first switch is in a first position or a second position, respectively; and first motor means for driving said foam/water nozzle from its first position to its second position, said motor means being coupled to said valve assembly control switch such that, when said first switch is in said first position, said valve assembly couples fluid to said piercing nozzle and said motor means is automatically energized to move said foam/water nozzle to its second position with its longitudinal axis essentially perpendicular to the longitudinal axis of said piercing nozzle.

2. An improved nozzle assembly as in claim 1 further including a second motor means on the outer end of said aerial boom for causing said piercing nozzle to have pivotal movement only in said vertical plane.

3. An improved nozzle assembly as in claim 2 further including:

a second switch coupled to said first motor means for selectively moving said foam/water nozzle incrementally between its first position to its second position essentially perpendicular to its first position; and a third switch coupled to said second motor means for selectively moving said piercing nozzle upwards or downwards in said vertical plane.

4. In an aerial boom system for a fire-fighting vehicle and having a fluid discharge nozzle assembly mounted on the outer end of an aerial boom with a fluid conduit for supplying a fire-retardant fluid to the nozzle assembly, an improved fluid discharge nozzle assembly comprising:

an elongated nozzle having a hollow piercing end, said piercing nozzle being coupled to the fluid conduit and having at least one orifice therein for expelling said fire-retardant fluid, said nozzle having use in penetrating a wall member to extinguish a fire behind said wall;

first pivotable mounting means on the outer end of said boom for supporting the hollow piercing nozzle for selective pivotal movement in a vertical plane only;

second pivotable mounting means coupled to the first pivotable mounting means for selective pivotal movement only in a direction perpendicular to the longitudinal axis of said elongated piercing nozzle; and an elongated fluid spray nozzle mounted on said second pivotable mounting means with its longitudinal axis in a first position essentially parallel to the longitudinal axis of said elongated piercing nozzle, said second pivotable mounting means enabling said elongated spray nozzle to be moved from its first position to a second position essentially perpendicular to its first position to be as far as possible away from said hollow piercing end when said piercing nozzle is to be used.

5. An improved fluid discharge nozzle as in claim 4 further including:

a first valve assembly coupling said fluid conduit to said piercing nozzle assembly and having an open and a closed position for selectively admitting fire-retardant fluid to said piercing nozzle;

a second valve assembly coupling said fluid conduit to said elongated fluid spray nozzle, said second valve assembly having an open and a closed position to selectively admit fire-retardant fluid to said elongated fluid spray nozzle; and valve control means coupled to said first and second valve assemblies such that when said first valve assembly is open, said second valve assembly is closed, and when said first valve assembly is closed, said second valve assembly is open.

6. An improved fluid discharge nozzle assembly as in claim 5 further including:

a first drive means coupled to said first pivotable mounting means for moving both the piercing nozzle and said fluid spray nozzle in a vertical plane only; and a second drive means coupled to said second pivotable mounting means for moving only said elongated fluid spray nozzle only in a direction perpendicular to the longitudinal axis of said hollow piercing nozzle so as to position the longitudinal axis of said fluid spray nozzle in its second position essentially perpendicular to its first position.

7. An improved fluid discharge nozzle assembly as in claim 6 further including:

a first switch coupled to said first drive means for selectively moving said piercing nozzle upwards or downwards in said vertical plane; and a second switch coupled to said second drive means for selectively moving said fluid spray nozzle in said plane perpendicular to the longitudinal axis of said piercing nozzle.

8. An improved fluid discharge nozzle assembly as in claim 7 further including:

a third switch coupled to said valve control means for selecting either said piercing nozzle or to said fluid spray nozzle for receiving fire-retardant fluid; and circuit means coupling said third switch to said second drive means for automatically moving said fluid spray nozzle to a position essentially perpendicular to the longitudinal axis of said piercing nozzle when said third switch selects said piercing nozzle to receive fire-retardant fluid.

* * * * *